US010201256B2

(12) United States Patent
Chang

(10) Patent No.: US 10,201,256 B2
(45) Date of Patent: Feb. 12, 2019

(54) PAPER CUTTING DEVICE EASY TO BE DISASSEMBLED AND MAINTAINED

(71) Applicant: Guangzhou Faner Aroma Product Co., Ltd., Guangzhou (CN)

(72) Inventor: Hsu-Hui Chang, Guangzhou (CN)

(73) Assignee: GUANGZHOU FANER AROMA PRODUCT CO., LTD., Guangzhou, Guangdong (CN)

( * ) Notice: Subject to any disclaimer, the term of this patent is extended or adjusted under 35 U.S.C. 154(b) by 0 days.

(21) Appl. No.: 15/647,255

(22) Filed: Jul. 11, 2017

(65) Prior Publication Data

US 2019/0014956 A1 Jan. 17, 2019

(51) Int. Cl.

| | |
|---|---|
| ***B26F 3/02*** | (2006.01) |
| ***A47K 10/38*** | (2006.01) |
| ***A47K 10/36*** | (2006.01) |
| ***B26D 1/02*** | (2006.01) |
| *B26D 1/00* | (2006.01) |
| *A47K 10/00* | (2006.01) |

(52) U.S. Cl.

CPC ..... *A47K 10/38* (2013.01); *A47K 10/36* (2013.01); *B26D 1/02* (2013.01); *A47K 10/00* (2013.01); *B26D 1/00* (2013.01)

(58) Field of Classification Search

CPC .. B26D 1/42; B26D 1/0006; B26D 2001/006; B26D 1/626; B26D 1/365; A47K 10/3637; A47K 10/3612; A47K 2010/365; A47K 10/3643; A47K 2010/3668; A47K 10/36; Y10T 225/20; Y10T 83/896; Y10T 83/4812; Y10T 225/205

USPC ..... 83/649; 225/10, 192, 93, 6, 16, 34, 51, 225/67, 46, 2, 36, 39; 242/566, 564, 242/564.1, 564.2, 560

See application file for complete search history.

(56) References Cited

U.S. PATENT DOCUMENTS

| | | | | |
|---|---|---|---|---|
| 5,924,617 | A * | 7/1999 | LaCount | A47K 10/3687 225/16 |
| 6,321,963 | B1 * | 11/2001 | Gracyalny | A47K 10/3656 225/2 |
| 8,220,684 | B1 * | 7/2012 | Keily | A47K 10/38 225/19 |
| 2006/0266784 | A1 * | 11/2006 | Kananen | B26D 1/365 225/6 |
| 2010/0243696 | A1 * | 9/2010 | Friesen | A47K 10/36 225/10 |

(Continued)

*Primary Examiner* — Ghassem Alie
(74) *Attorney, Agent, or Firm* — Leong C. Lei

(57) ABSTRACT

A paper cutting device includes a support frame, first rotating shaft and cover. The support frame is defined with an accommodation space with a forward opening, and the two ends of the accommodation space are in combination with two side plates in opposite to each other; the first rotating shaft is configured between the two side plates and positioned in the accommodation space, allowing the first rotating shaft to be rotated in the accommodation space; the cover is in movable combination with the two side plates of the support frame and positioned relatively at the forward opening of the accommodation space, the cover adapted to cover the first rotating shaft. Furthermore, a knife assembly is mounted in a breach configured on the first rotating shaft, and protruding shafts configured on the two ends thereof can be slid in corresponding closed annular guide grooves configured on the two side plates.

10 Claims, 12 Drawing Sheets

(56) References Cited

U.S. PATENT DOCUMENTS

2012/0125968 A1* 5/2012 Friesen ..... B26D 1/42
225/10

* cited by examiner

PAPER CUTTING DEVICE EASY TO BE DISASSEMBLED AND MAINTAINED

(a) TECHNICAL FIELD OF THE INVENTION

The present invention relates to a paper cutting device easy to be disassembled and maintained, and more particularly to a paper cutting device in which a knife assembly can be driven to move to and fro to cut a paper towel without needing a power supply when the paper towel is pulled.

(b) DESCRIPTION OF THE PRIOR ART

To allow users to wipe their hands dry after washing them in general public toilets, paper towel supply devices are always installed close to public toilet's washbasin. Conventional paper towel supply devices are mainly configured with a roll inside a housing, which is adapted to mount with drum paper towel, and a fixed knife seat is configured on the opening of the bottom of the housing.

Paper towel exposed out of the bottom of the housing is first pulled downward when a user wants to use it, and it is then pulled transversely and cut by a knife seat configured on the housing. Thereafter, the cut paper towel is used to clean the water stains on the user's hands.

However, the paper towel supply devices mentioned above must be pulled manually by users to allow the paper towel to be cut by the knife seat such that the irregular cut paper towel is easy to be formed upon the pulling of the paper towel. In addition, when a user (e.g. a child) pulls a paper towel with a large force, it cannot be cut effectively, causing it to be pulled out too long, resulting in a waste of paper towels and the breeding of bacteria in the overlong exposed paper towel when it touches a washbasin or floor.

SUMMARY OF THE INVENTION

The present invention proposes a paper cutting device easy to be disassembled and maintained, including a support frame, first rotating shaft and cover. The support frame is defined with an accommodation space with a forward opening, and the two ends of the accommodation space are in combination with two side plates in opposite to each other; the first rotating shaft is configured between the two side plates and positioned in the accommodation space, allowing the first rotating shaft to be rotated in the accommodation space; the cover is in movable combination with the two side plates of the support frame and positioned relatively at the forward opening of the accommodation space, the cover adapted to cover the first rotating shaft. Furthermore, a knife assembly is mounted in a breach configured on the first rotating shaft, and protruding shafts configured on the two ends thereof can be slid in corresponding closed annular guide grooves configured on the two side plates.

Whereby, a paper towel is first wound around the first rotating shaft and then extended out of the support frame. Thereafter, the paper towel is in contact with the first rotating shaft and drives the first rotating shaft to rotate when the paper towel is pulled, and the first rotating shaft then drives the protruding shafts configured on the knife assembly to slide in the corresponding guide grooves configured on the two side plates, allowing the knife assembly to be moved to and fro in the breach of the first rotating shaft and extended out of the breach, thereby cutting the paper towel actively with the knife assembly, achieving cutting the paper towel without power supply. In addition, the cover can be taken down quickly to pull out a paper jam part of the paper towel if the paper towel is jammed because the cover is in movable combination with the two side plates of the support frame, achieving quick, convenient paper jam maintenance.

DETAILED DESCRIPTION OF THE PREFERRED EMBODIMENTS

Figure 1:
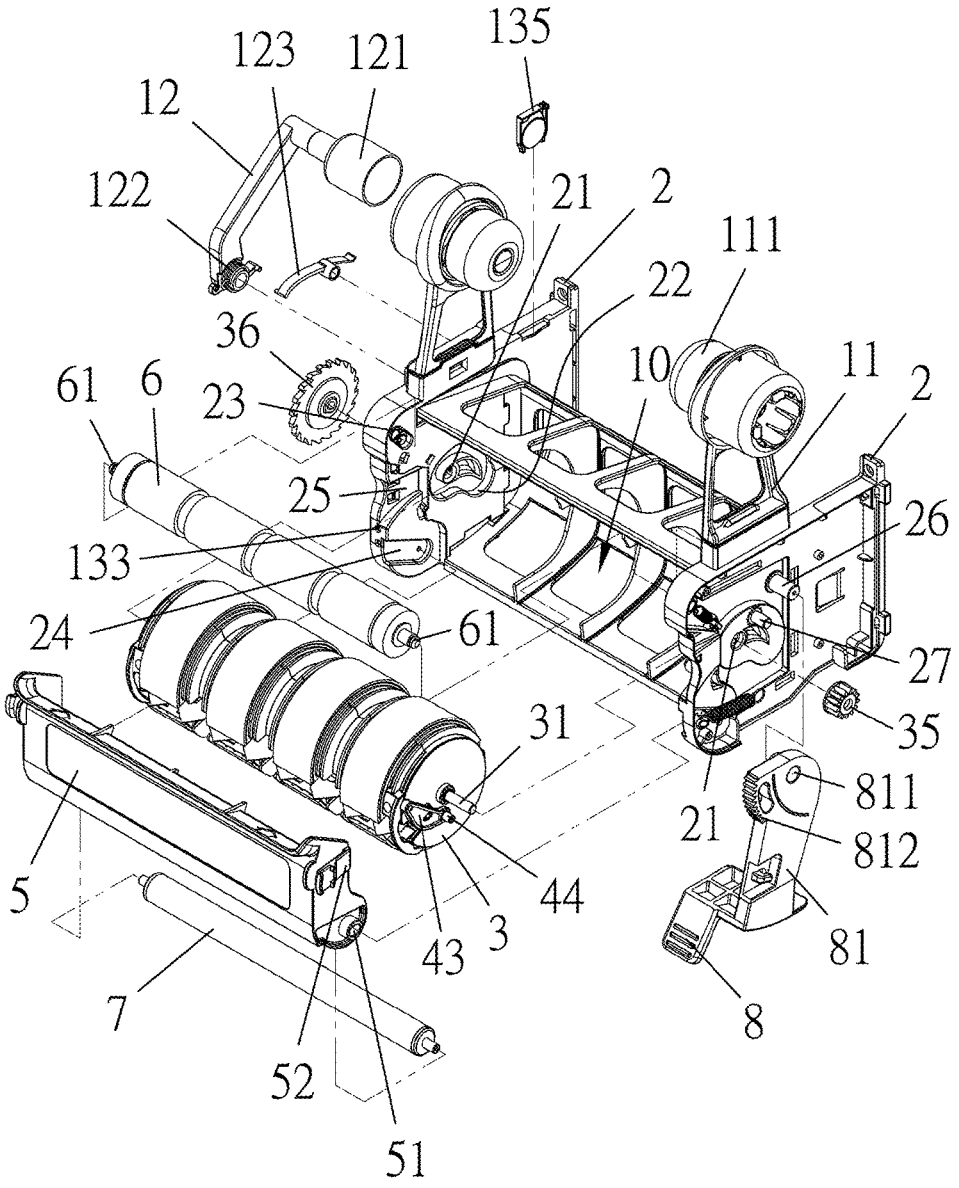
FIG. 1 is an exploded view of a preferred embodiment of a paper cutting device according to the present invention.
Figure 2:
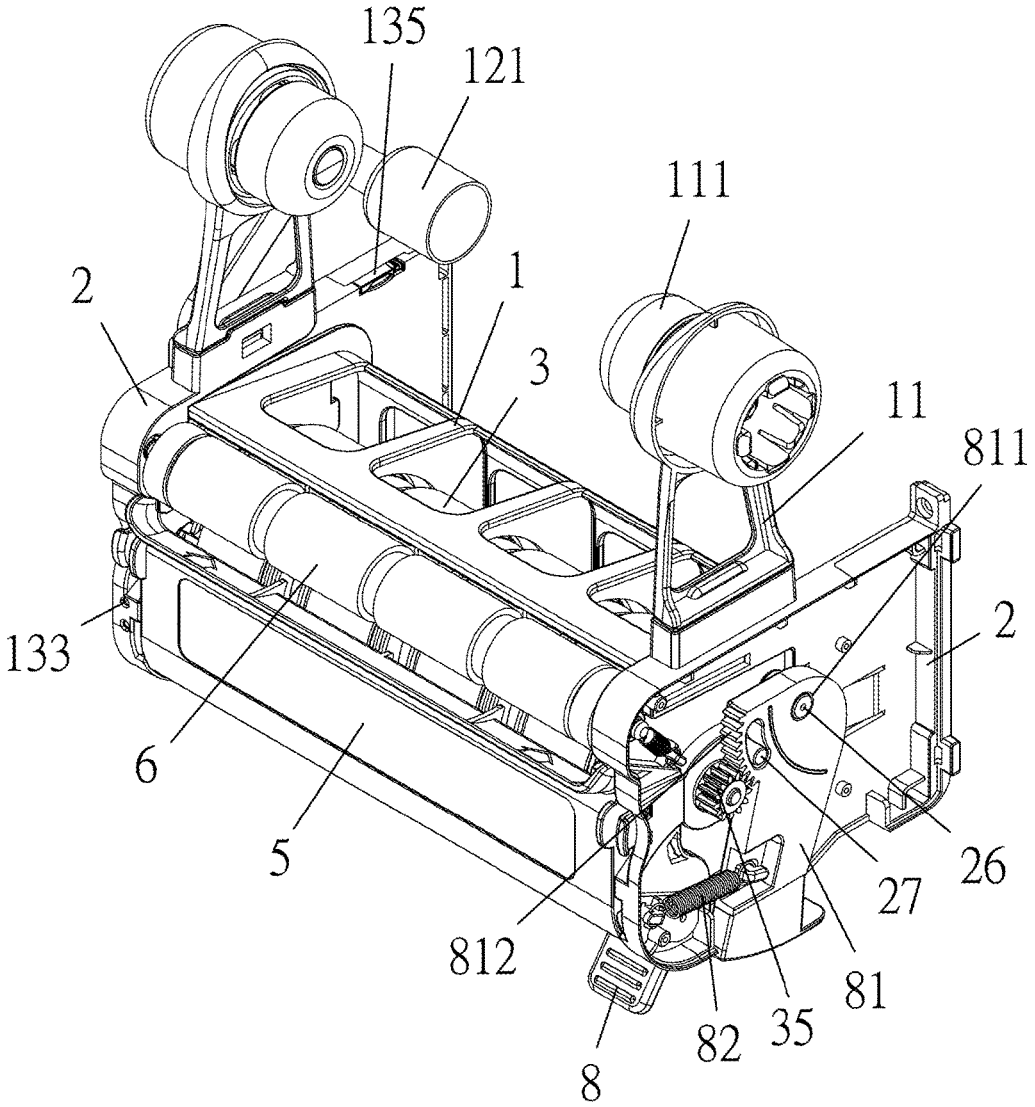
FIGS. 2 and 3 respectively are a perspective view of the embodiment of the present invention.

Referring to FIGS. 1 to 5, the present invention discloses a paper cutting device easy to be disassembled and maintained, including a support frame 1, first rotating shaft 3, cover 5, second rotating shaft 6 and third rotating shaft 7.

Figure 10:
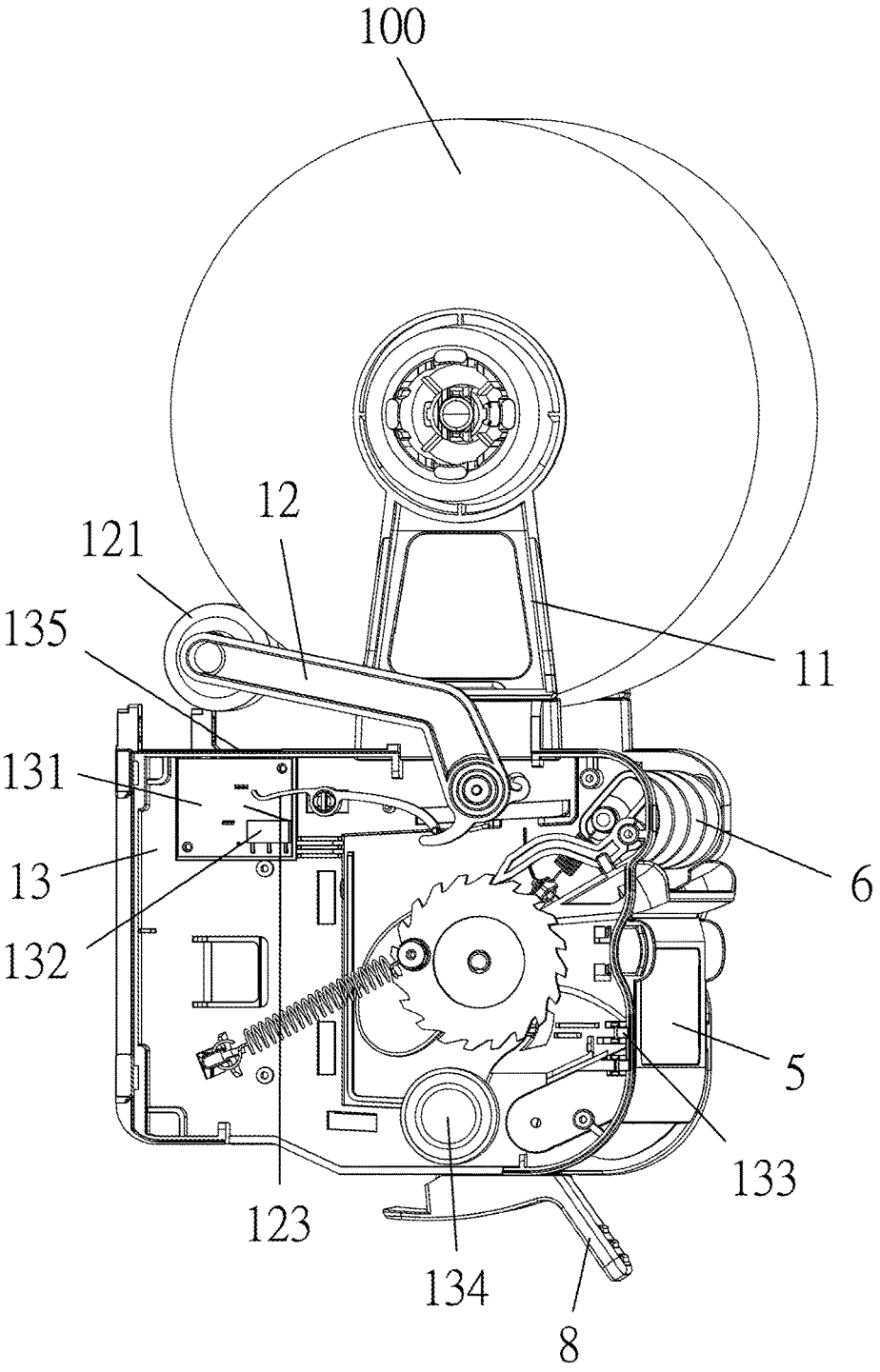
FIG. 10 is a schematic view of the paper cutting device of the present invention upon implementation.

The support frame 1 defines an accommodation space 10 opened forward, the two sides of which each in combination with a side plate 2, and the two side plates 2 are in opposition to each other, and the tops thereof are respectively configured with a first rod body 11, the two first rod bodies 11 being respectively configured with a first raised portion 111 and both of them being in opposition to each other, where the two first raised portions 111 are adapted to install a preset drum paper towel 100 as FIG. 10 shows. Furthermore, the two side plates are respectively configured with a first axle hole 21, and a closed annular guide groove 22 indented around the first axle hole 21 is respectively configured on the inner wall faces of the two side plates 2, allowing the first axle holes 21 and guide grooves 22 to be in opposition to each other in the accommodation space 10, where each guide groove 22 is configured with a depression section 221. In addition, the inner wall faces of the two side plates 2 are further respectively indented with a first positioning portion 24 and second positioning portion 25, the two first and second positioning portions 24, 25 being in opposition to each other and positioned relatively outside the accommodation space 10 and adjacent to the edges of the side plates 2. Furthermore, a second axle hole 23 above the second positioning portion 25 is respectively configured on the two side plates 2, and a first shaft 26 is respectively configured on the outer wall faces of the two side plates 2, with a second shat 27 configured on the outer wall face of one of the two side plates 2. In addition, the support frame 1 is further configured with a second rod body 12 and a control module 13, where one end of the second rod body 12 is extended transversely with a contact portion 121 and another end thereof is configured with a first axle joint 122, where the contact portion 121 is positioned relatively behind the first rod body 11, the first axle joint 122 is in connection with the outer wall face of one of the side plates 2, and the first axle joint 122 is configured with a return spring allowing the contact portion 121 of the second rod body 12 to be moved toward the first rod body 11, with the tip of the first axle joint 122 of the second rod body 12 extended with a touch portion 123. Furthermore, the control module 13 is configured on the support frame 1 and includes a control circuit board 131 and pressing switch 132, where the control circuit board 131 is in electric connection with at least one light emitting element 133 (e.g. light emitting diode (LED)), speaker and cell unit 135, the pressing switch 132 is in electric with the control circuit board 131, and the pressing switch 132 is adjacent to one side of the touch portion 123 of the second rod body 12, allowing the touch portion 123 of the second rod body 12 to touch the pressing switch 132 for the electric conduction.

Figure 3:
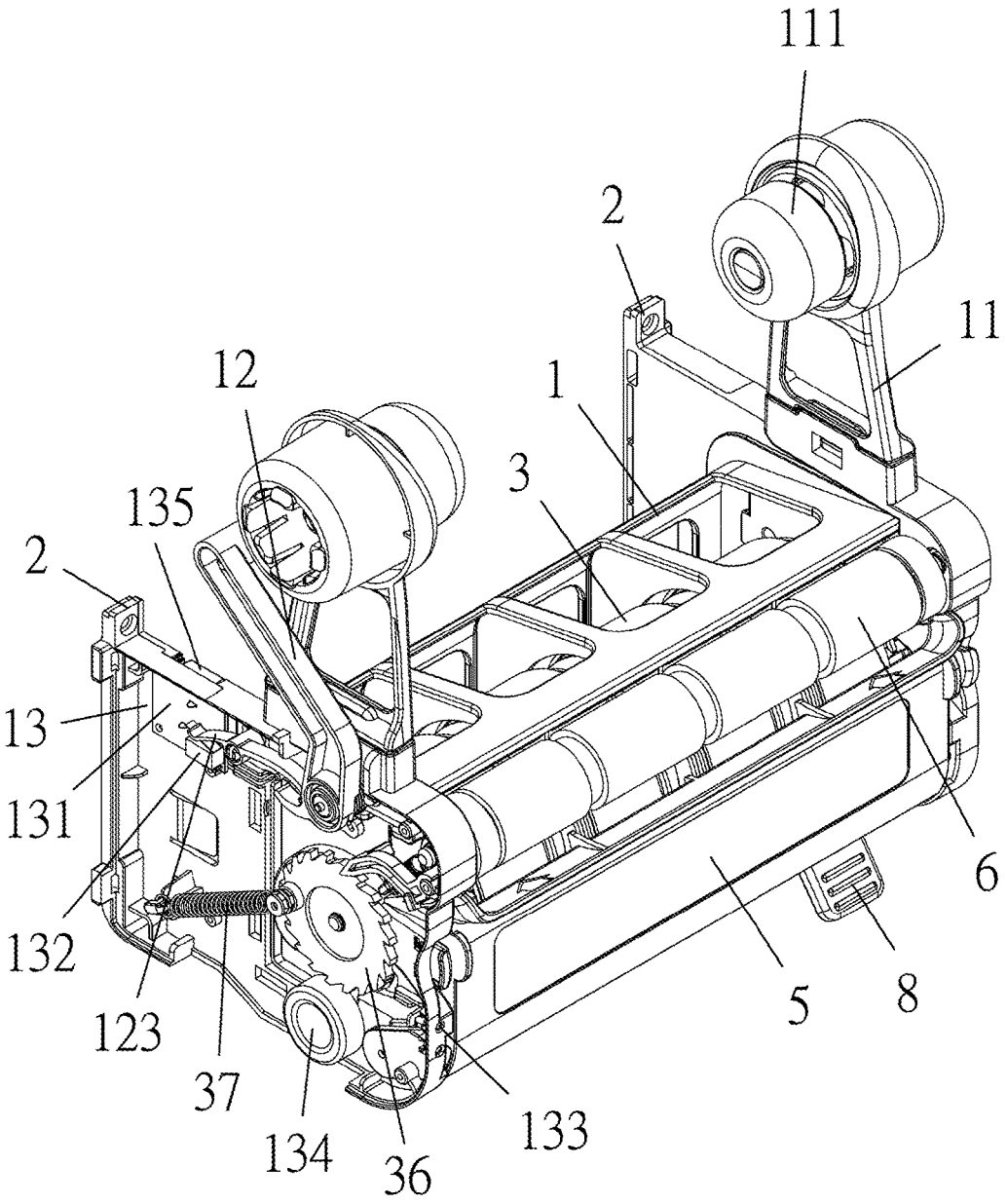
Figure 4:
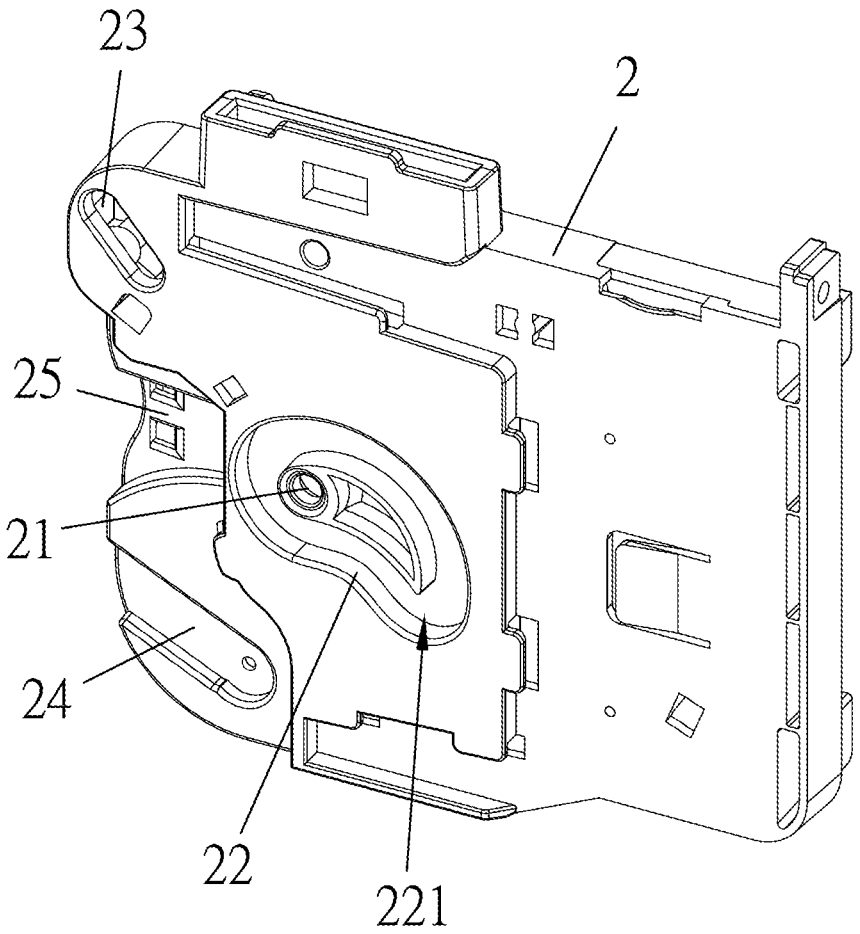
FIG. 4 is a perspective view of a side plate of the paper cutting device of the present invention.
Figure 5:
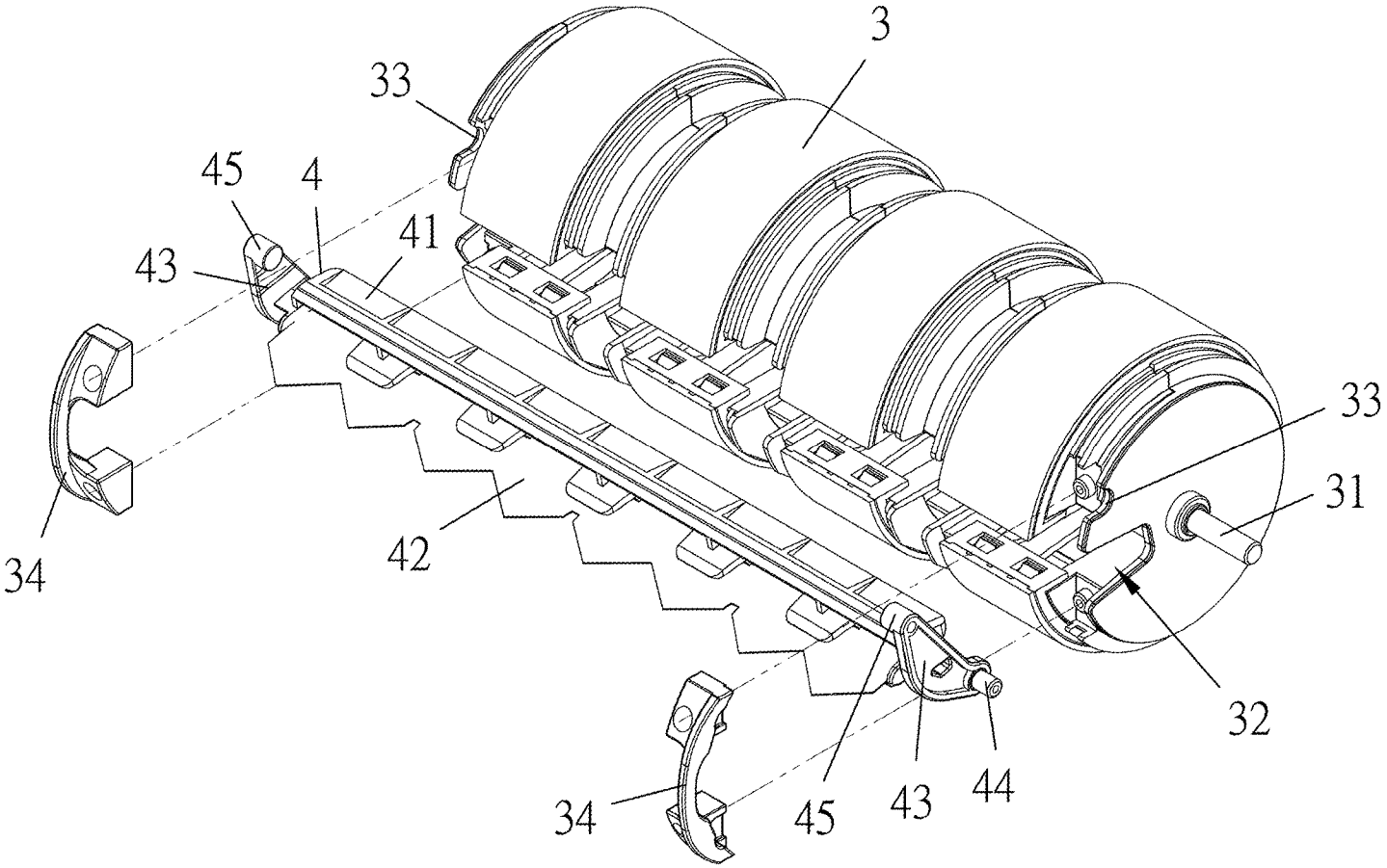
FIG. 5 is an exploded view of a first rotating shaft of the paper cutting device of the present invention.

The first rotating shaft 3 is configured inside the accommodation space 10 of the support frame 1, the two ends of the first rotating shaft 3 are respectively extended with a first axle center 31, and the two first axle centers 31 are passed through the two corresponding first axle holes 21 of the two side plates 2, allowing the first rotating shaft 3 to be rotated in the accommodation space 10 of the support frame 1. Furthermore, a breach 32 is configured on the first rotating shaft 3, and a movable knife assembly 4 is configured in the breach 32, where the knife assembly 4 is provided with a base 41, one side of which is in combination with a knife 42, and the two ends of which are respectively configured with a first support arm 43, on which a protruding shaft 44 and second raised portion 45 are configured, where the protruding shaft 44 is positioned outside the first rotating shaft 3 and relatively inside the guide groove 22 of the side plate 2. Furthermore, a third positioning portion 33 and fixing element 34 are respectively configured on the two ends of the first rotating shaft 3 around the breach 32; the knife assembly 4 is mounted in the breach 32 of the first rotating shaft 3, the second raised portion 45 of the knife assembly 4 is in engagement with the third positioning portion 33, and the fixing elements 34 is used to block the knife assembly 4 for the prevention thereof from dropping out, allowing the knife assembly 4 to be moved to and fro inside the breach 32 of the first rotating shaft 4 (for example, moved telescopically front and rear) and extended out of the breach 32. Furthermore, the first axle center 32 on one end of the first rotating shaft 3 is passed through the side plate 2 and put around with a first gear 34, which is positioned relatively at one side of the second shaft 27 of the side plate 2; the first axle center 31 on another end of the first rotating shaft 3 is passed through the side plate 2 and put around with a rotating sheet 36 which is eccentrically in combination with a first elastic element 37, another end of which is fixed to the side plate 2 as FIG. 3 shows, allowing the first rotating shaft 3 to have a reset mechanism upon the rotation thereof through the pulling of the first elastic element 37.

The cover 5 is in movable combination with the two side plates 2 of the support frame 1 and positioned relatively on the frontward opening of the accommodation space 10, the cover 5 adapted to cover the first rotating shaft 3; the two ends of the cover 5 are respectively configured with a third positioning portion 51 and fourth positioning portion 52, where the third positioning portions 51 of the cover 5 are in movable combination with the corresponding first positioning portions 24 of the side plate 2, and the fourth positioning portions 52 of the cover 5 the corresponding second positioning portions 25 of the side plates 2, allowing the cover 5 to be assembled with or disassembled from the two side plates 2 of the support frame 1 quickly. Furthermore, the bottom of the cover 5 facing the accommodation space 10 of the support frame 1 is in combination with the third rotating shaft 7.

The two ends of the second rotating shaft 6 are respectively configured with a second axle center 61, and the two axle centers 61 are respectively passed through the corresponding second axle holes 23 of the two side plates 2, allowing the second rotating shaft 6 to be positioned relatively above the second positioning portions 25.

Figure 7:
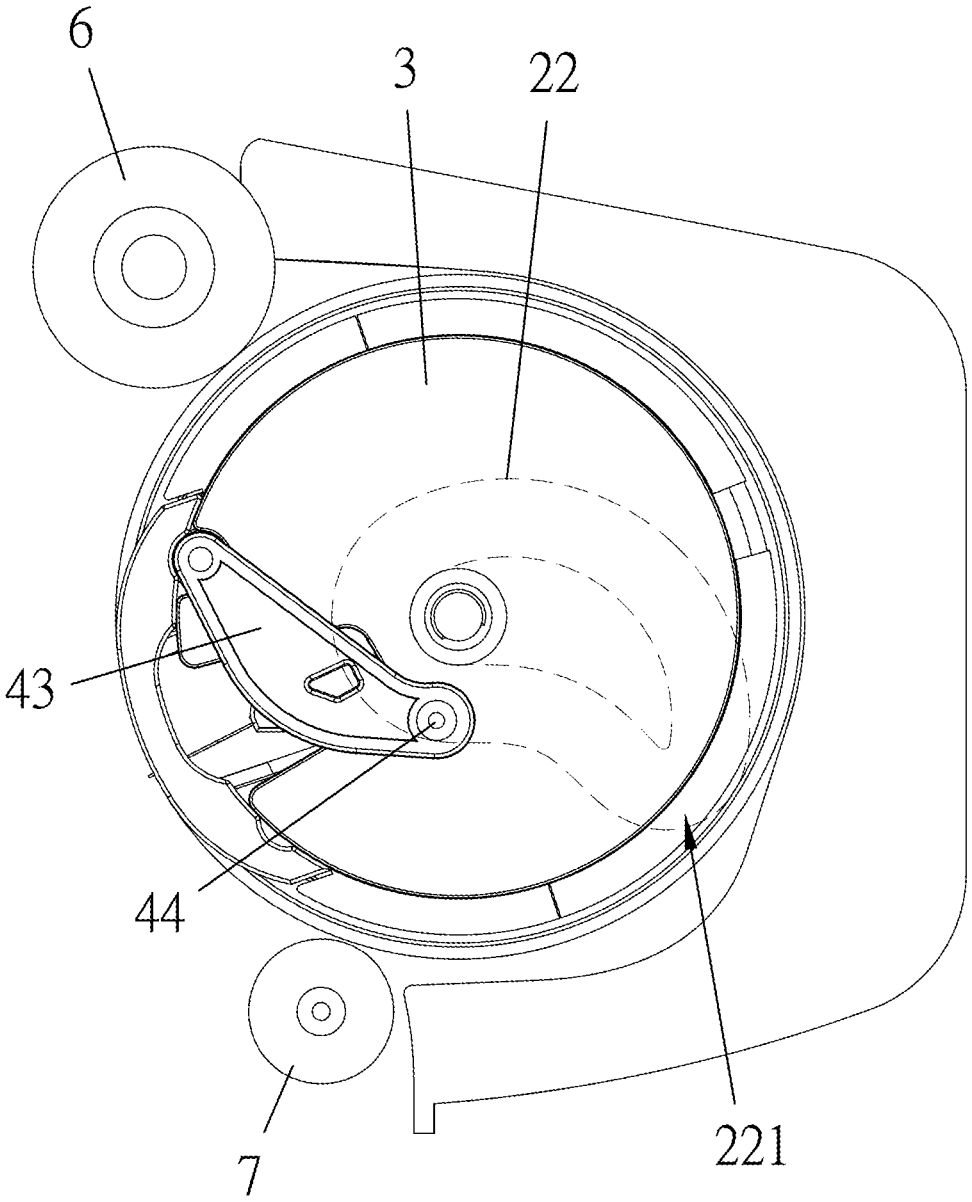
FIGS. 7, 8 and 9 respectively show a knife assembly of the paper cutting device of the present invention in action.
Figure 8:
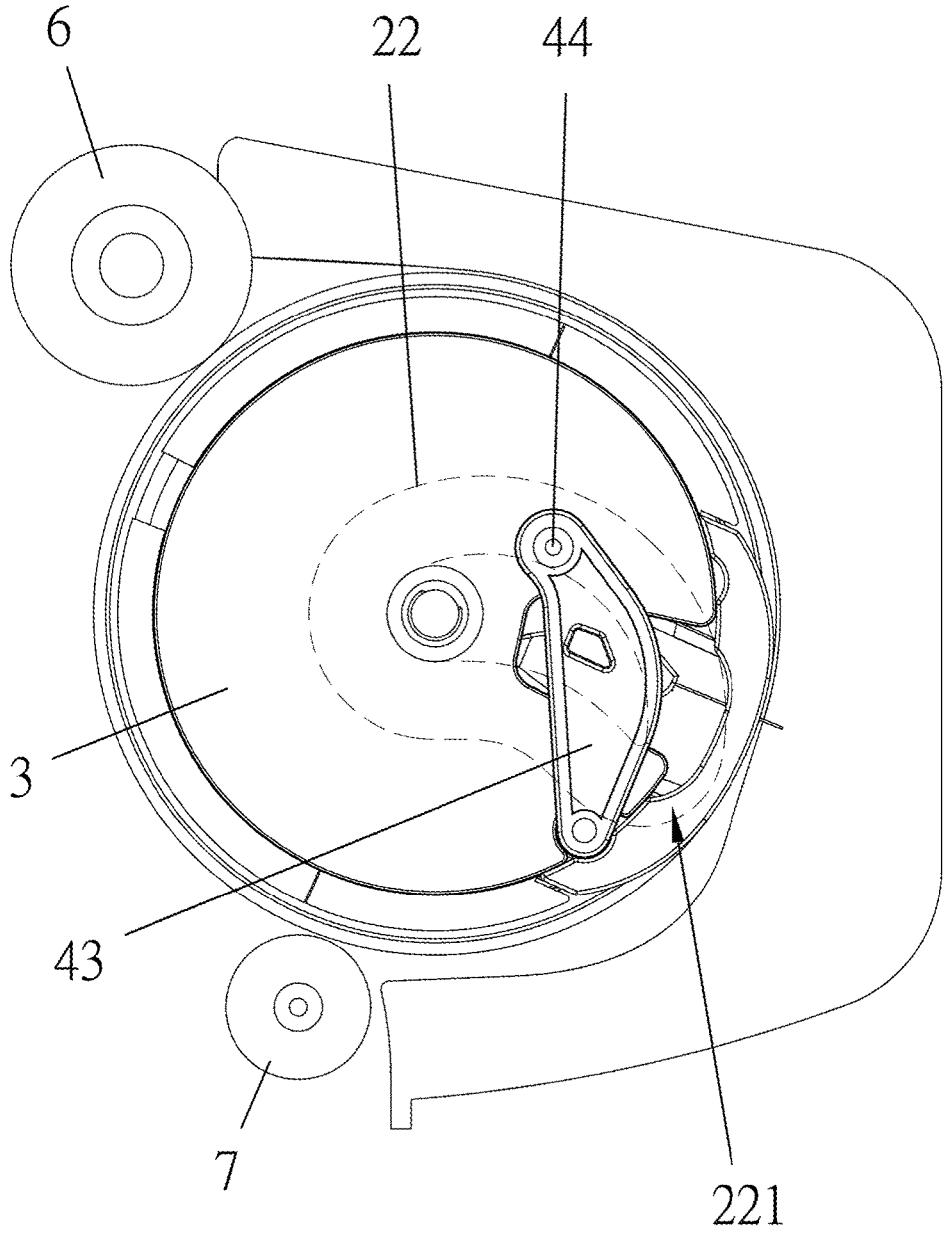
Figure 9:
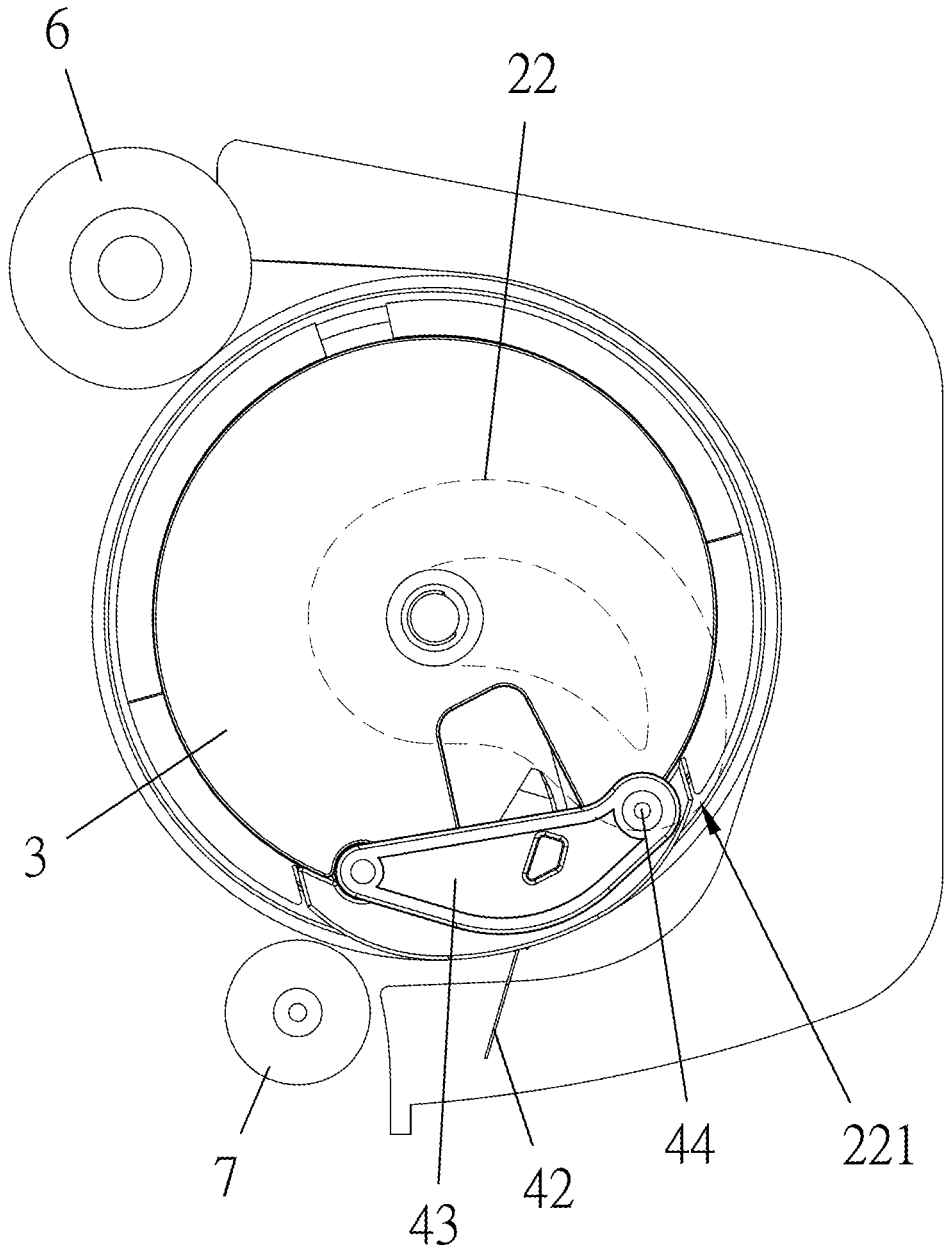
Figure 12:
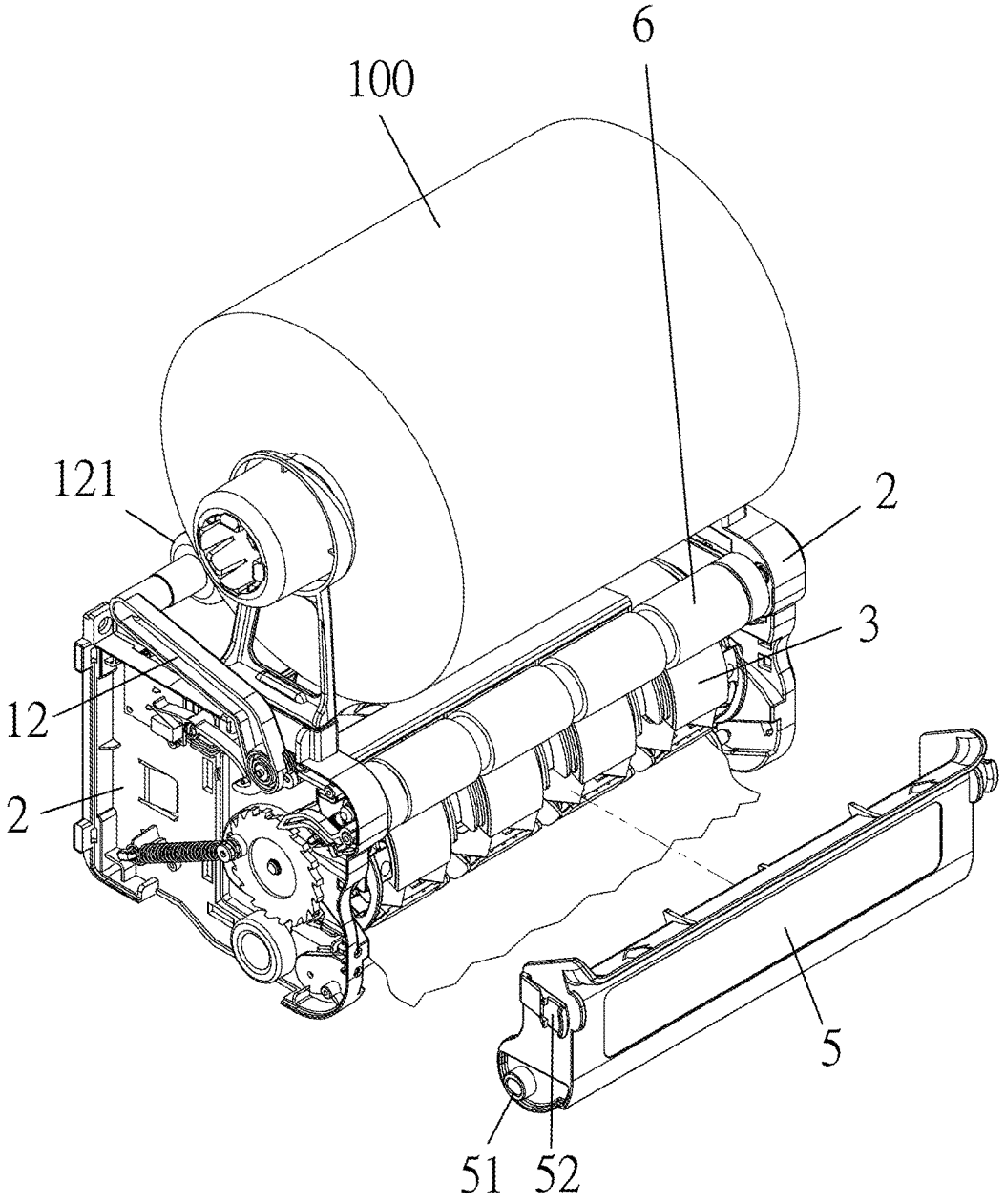
FIG. 12 is a schematic view of an example of the paper cutting device of the present invention when paper jam happens.

In a preferred embodiment, a paper towel 100 can be wound around the second rotating shaft 6, first rotating shaft 3 and third rotating shaft 7 in sequence, and then extended out from the bottom of the cover 5, allowing the paper towel 100 to be wound around the surface of the first rotating shaft 7. When a user pulls out the paper towel 100, the paper towel 100, when pulled, can be in frictional contact with the first rotating shaft 3 to drive the first rotating shaft 3 to rotate. At this time, the first rotating shaft 3 then drives the protruding shafts 44 of the knife assembly 4 to slide in the corresponding guide grooves 22 configured on the two side plates 2 when the first rotating shaft 3 is rotated as FIGS. 7, 8 and 9 show. Thereafter, when the protruding shafts 44 of the knife assembly 4 are positioned on the corresponding depression sections 221 of the guide grooves 22, the knife 42 of the knife assembly 4 is pushed out of the breach 32 of the first rotating shaft 3 so that the knife 42 of the knife assembly 4 can be used to cut the paper towel 100 actively, thereby cutting the paper towel 100 at a fixed length without needing a power supply. In addition, the cover 5 can be taken down quickly to allow a jammed part of the paper towel 100 to be pulled out when the paper towel 100 is jammed because the cover 5 is in movable combination with the two side plates 2 of the support frame 1, as FIG. 12 shows. Therefore, the present invention can achieve quick, convenient paper jam maintenance.

Figure 11:
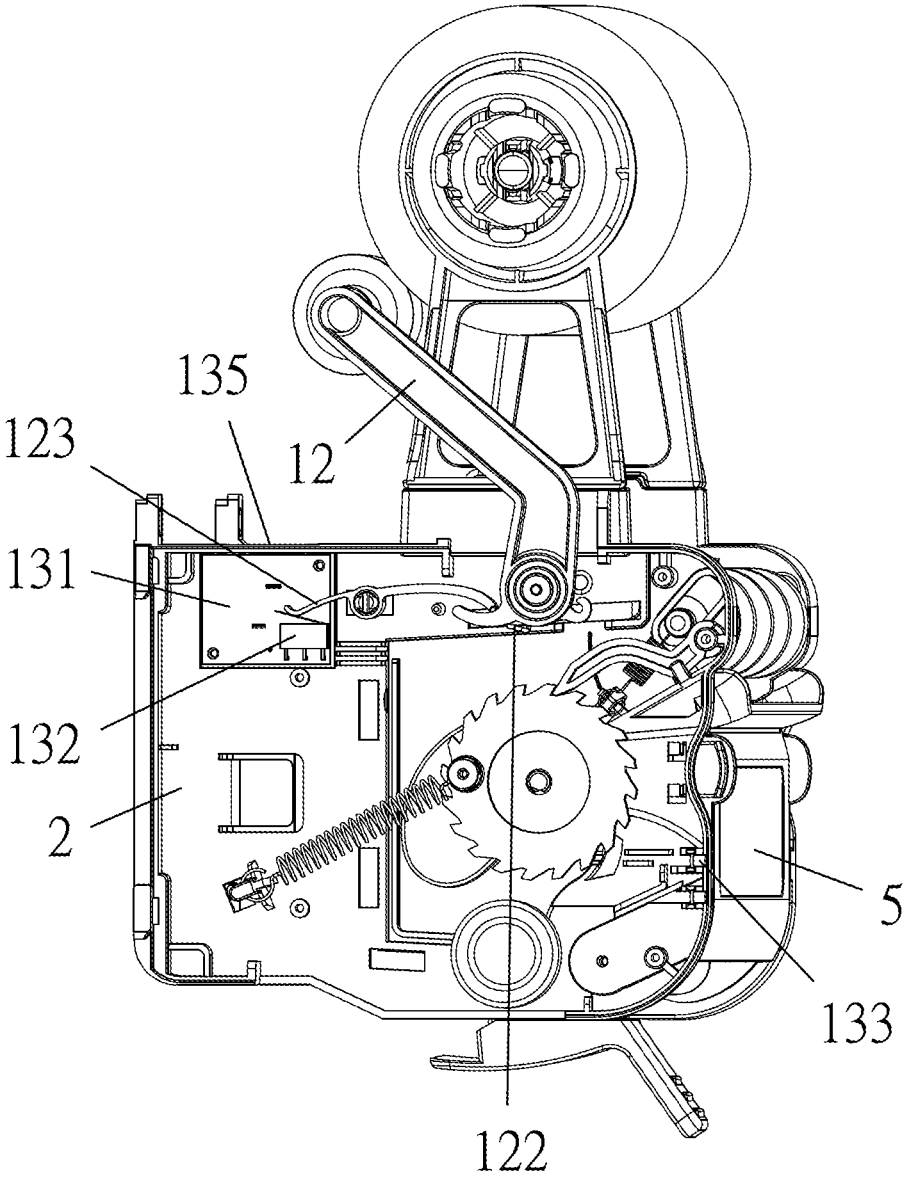
FIG. 11 is a schematic view of an example of the paper cutting device of the present invention when the replenishment of a paper towel is needed.

Referring to FIGS. 3, 10 and 11, when the paper towel 10 is installed, it will press the contact portion 121 of the second rod body 12, and the touch portion 123 will not press the pressing switch 132 at this time; when the paper towel 100 is not installed, the contact portion 121 of the second rod body 12 is not pressed by the paper towel 100, allowing the contact portion 121 of the second rod body 12 to be moved toward the first rod body 11, and the touch portion 123 of the second rod body 12 will touch the pressing switch 132 to conduct electricity at this time to make the light emitting element 133 in electric connection with the control circuit board 131 brighten (e.g. glisten) and the speaker configured on the control circuit board 131 sound, achieving the automatic detection of the existence of the paper towel 100, where the light emitting element 133 may be configured on the front end of the side plate 2, allowing a user to detect the light emitted by the light emitting element 133 clearly, as FIG. 11 shows.

Furthermore, referring to FIGS. 1 and 2 again, the paper cutting device of the present invention further includes a pressing rod 8, the two ends of which are respectively configured with a second support arm 81, each of which is configured with a third axle hole 811, where the third axle holes 811 of the two second support arms 81 are in engagement with the first axle shaft 26 of the two side plates 2, allowing the pressing rod 8 to be in combination with the support frame 1 and the outer sides of two side plates 2. Furthermore, one of the second support arms 81 is configured with a section gear 812 engaged with a first gear 35 of the first rotating shaft 3, where the second support arm 81 is in combination with a second elastic element 82, another end of which is fixed to the side plate 2, allowing the pressing rod 8 to have an elastic reset function. Thereupon, a user may press the above pressing rod 8 to drive the first gear 35 and first rotating shaft 3 to rotate through the section gear 812 of the pressing rod, achieving the automatic sending and cutting of the paper towel 100.

Figure 6:
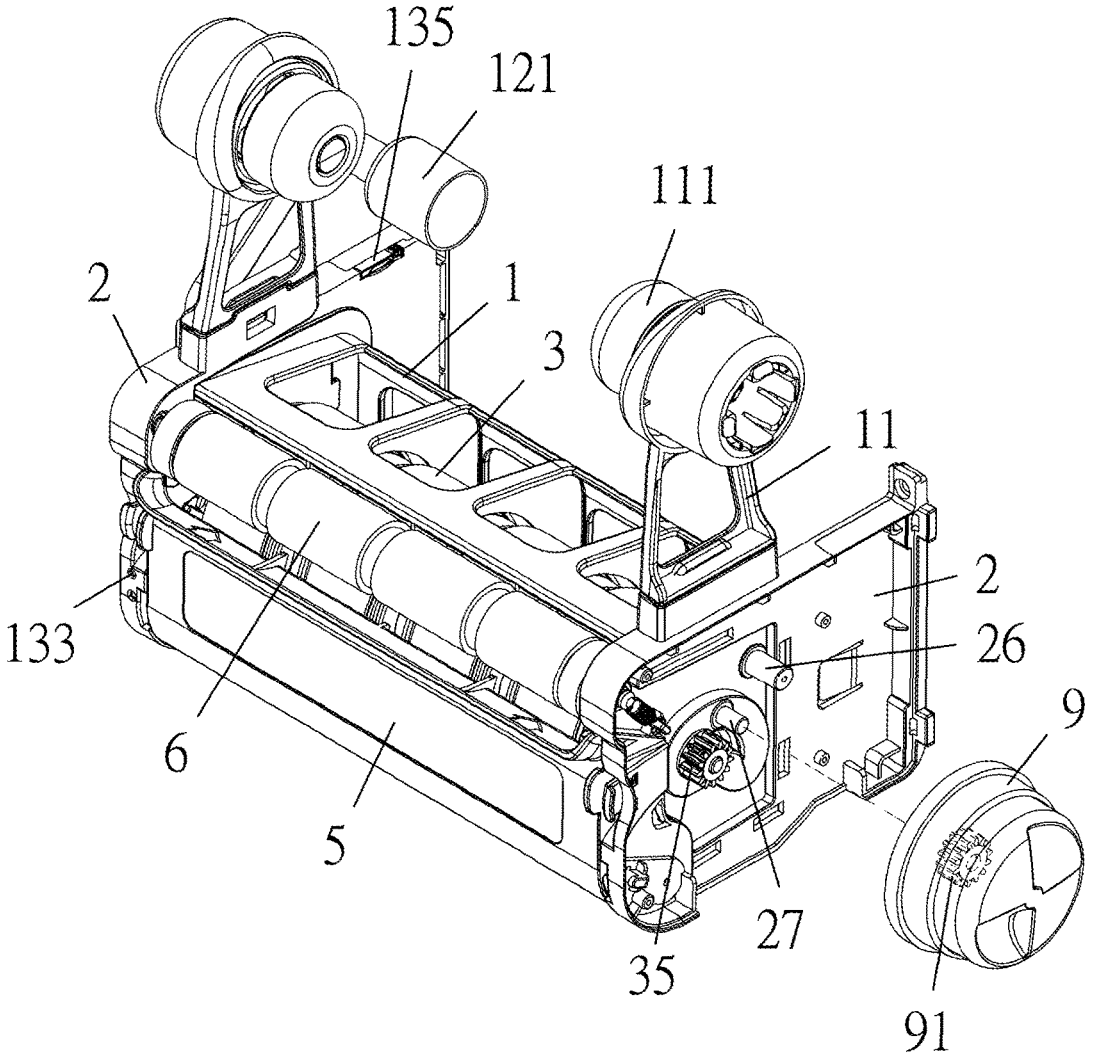
FIG. 6 is a perspective view of another preferred embodiment of the paper cutting device according to the present invention.

Referring to FIG. 6, the paper cutting device of the present invention further includes a knob 9, inside which a second gear 91 is configured, where the second gear 91 may be installed on the second axle shaft 27 of one of the side plates 2 and engaged with the first gear 35 of the first rotating shaft 3, allowing users to drive the first gear 35 and first rotating shaft 3 to rotate through the second gear 91 of the knob 9 by turning the knob 9, achieving the same automatic sending and cutting of the paper towel 100.

Furthermore, the control module 13 of the present invention is further configured with a power generation module 134, which is driven by the first rotating shaft 3 to generate electric power. When a user pulls out the paper towel 100, it can be in frictional contact with the first rotating shaft 3 upon the pulling thereof and drive the first rotating shaft 3 at the same time. At this time, the power generation module 134 can be driven to generate power when the first rotating shaft 3 is being rotated, and the power generation module 134 transmits the power to the control circuit board 131, allowing the light emitting element 133 configured on the control circuit board 131 to be lighted. Furthermore, the control circuit board 131 is further configured with a voice chip, thereby allowing the audio signals preset in the voice chip to be broadcasted by the speaker configured on the control circuit board when the power generation module 134 transmits the power to the control circuit board 131. In addition, the cell unit 135 configured on the control module 13 may be a detachable cell; it supplies the power to the control circuit board 131 to allow the light emitting element 133 to be lighted and the speaker to broadcast the audio signal preset in the voice chip.

I claim:

1. A paper cutting device easy to be disassembled and maintained, comprising:

a support frame, defined with an accommodation space with a forward opening, two side plates opposite to each other in combination with two ends of said accommodation space, a first rod body respectively configured on tops of said two side plates, said two first rod bodies configured inward with two first raised portions opposite to each other, said two first raised portions adapted to install a preset paper towel, said two side plates respectively configured with a first axle hole, a closed annular guide groove indented around said first axle hole and on an inner wall of each one of said two side plates, said first axle holes and guide grooves positioned relatively in said accommodation space, said first positioning portion and second positioning portion further respectively having an indentation on said inner wall of said two side plates, said two first positioning portions in opposition to each other and said two second positioning portions in opposition to each other, and said first, second positioning portions positioned relatively outside said accommodation space and adjacent to an edge of said side plate;

a first rotating shaft, configured in said accommodation space of said support frame, two ends thereof respectively extended with a first axle center, two first axle centers passed through said two corresponding first axle holes, allowing said first rotating shaft to be rotated in said accommodation space of said support frame, said first rotating shaft configured with a breach, a movable knife assembly configured in said breach, and two ends of said knife assembly respectively configured with a protruding shaft positioned relatively in said guide groove of said side plate, allowing said protruding shaft of said knife assembly to be slid in said guide groove; and a cover, in movable combination with said two side plates and adapted to cover said first rotating shaft, two ends of said cover respectively configured with a third positioning portion and fourth positioning portion, said third positioning portion in movable combination with said first positioning portion of said side plate, and said fourth positioning portion said second positioning portion, wherein said cover is in movable combination with said two side plates, allowing said cover place to be taken down quickly; said paper towel is used to be in contact with said first rotating shaft and drive said first rotating shaft to rotate when pulled, said first rotating shaft then drives said protruding shaft of said knife assembly to slide in said guide groove when said rotating shaft is rotated, allowing said knife assembly to be moved to and fro in said breach of said first rotating shaft and extended out of said breach to cut said paper towel.

2. The device according to claim 1, wherein said support frame is further configured with a second rod body and control module, one end of said second rod body is extended transversely with a contact portion and another end thereof is configured with a first axle joint, said contact portion is positioned relatively behind said first rod body, said first axle joint is in connection with an outer wall face of one of said side plates and configure with a return spring allowing said contact portion of said second rod body to be moved toward said first rod body, and a touch portion is extended from a tip of said first axle joint of said second rod body; said control module is configured on said support frame and comprises a control circuit board and a pressing switch in electric connection with said control circuit board and adjacent to one side of said touch portion of said second rod body, allowing said touch portion of said second rod body to touch and conduct said pressing switch.

3. The device according to claim 2, wherein said control circuit board is configured with at least one light emitting element, speaker and cell unit.

4. The device according to claim 3, wherein a power generation module is further configured on said first axle center of said first rotating shaft and in electric connection with said control circuit board, power is generated from said power generation module and transmitted thereby to said control circuit board, and said control circuit board is further configured with a voice chip.

5. The device according to claim 1, wherein said guide groove is configured with a depression section, allowing said knife assembly to be pushed out of said breach of said first rotating shaft when said protruding shaft of said knife assembly is positioned on said depressing section.

6. The device according to claim 5, wherein said knife assembly is configured with a base, one side of said base is in combination with a knife, two ends of said base are respectively configured with a first support arm having said protruding shaft and a second raised portion, a third positioning portion and fixing element are respectively configured around said breach at two ends of said first rotating shaft, said second raised portion of said knife assembly is in combination with said third positioning portion, and said fixing element is used to block said knife assembly.

7. The device according to claim 1, further comprising a pressing rod, two ends thereof respectively configured with a second support arm configured with a third axle hole, one of said second support arm configured with a section gear, outer wall faces of said two side plates respectively configured with a first axle rod, said third axle holes of said two second support arms in combination with said corresponding first axle rods of said two side plates, a first axle center on one end of said first rotating shaft passed through said side plate and put around with a first gear, and said section gear of said second support arm in engagement with said first gear of said first rotating shaft.

8. The device according to claim 7, wherein said second support arm is in combination with a second elastic element, and another end thereof is fixed to said side plate, allowing said pressing rod to have an elastic reset mechanism.

9. The device according to claim 1, further comprising a knob, a second gear configured inside said knob, an outer wall face of one of said side plate configured with a second axle rod, said first axle center on one end of said first rotating shaft passed through said side plate in engagement with a first gear, said second gear capable of being installed on said second axle rod of said side plate, and said second gear in engagement with said first gear of said first rotating shaft.

10. The device according to claim 1, further comprising a second rotating shaft and third rotating shaft, two ends of said second rotating shaft respectively configured with a second axle center, a second axle hole relatively above said second positioning portion respectively configured on said two side plates, said two second axle centers passed through said two corresponding second axle holes, and said third rotating shaft in combination with a bottom of said cover facing said accommodation space.

* * * * *